US009441338B2

(12) United States Patent
Courcelles

(10) Patent No.: US 9,441,338 B2
(45) Date of Patent: Sep. 13, 2016

(54) SNOWPLOW BLADE

(71) Applicant: GARDEX LTÉE, Mont-Laurier (CA)

(72) Inventor: Jacques Courcelles, Mont-Laurier (CA)

(73) Assignee: GARDEX LTÉE, Mont-Laurier (CA)

( * ) Notice: Subject to any disclaimer, the term of this patent is extended or adjusted under 35 U.S.C. 154(b) by 0 days.

(21) Appl. No.: 14/550,381

(22) Filed: Nov. 21, 2014

(65) Prior Publication Data

US 2015/0267367 A1 Sep. 24, 2015

Related U.S. Application Data

(60) Provisional application No. 61/968,065, filed on Mar. 20, 2014.

(51) Int. Cl.
*E01H 5/06* (2006.01)

(52) U.S. Cl.
CPC ..... *E01H 5/065* (2013.01); *E01H 5/061* (2013.01)

(58) Field of Classification Search
CPC ..... E01H 5/06; E01H 5/065; E01H 5/066; E01H 5/067; E01H 5/061
USPC ..... 37/274, 275
See application file for complete search history.

(56) References Cited

U.S. PATENT DOCUMENTS 1,480,581 A * 1/1924 Webb ..... E01H 5/065 37/275
1,665,733 A * 4/1928 Clark ..... E01H 5/065 29/14
1,927,078 A * 9/1933 Weeks ..... E01H 5/067 37/234
2,085,996 A * 7/1937 Phillips ..... E01H 5/066 37/260
2,137,321 A * 11/1938 Austin ..... E01H 5/06 37/274
2,632,263 A * 3/1953 Cooper ..... E01H 5/04 172/80
2,663,098 A * 12/1953 Frink ..... E01H 5/065 172/252
3,426,458 A * 2/1969 Spitzer ..... E01H 1/056 37/271
4,885,852 A * 12/1989 Gudmundsson ..... E01H 5/106 37/260
6,009,642 A * 1/2000 Nugent ..... E01H 5/00 37/197
6,202,328 B1 * 3/2001 Fulton ..... E01H 5/068 37/231
7,661,210 B2 * 2/2010 Shepherd ..... E01H 5/06 172/396
2006/0288617 A1 * 12/2006 Colclough ..... E01H 5/066 37/264

* cited by examiner

*Primary Examiner* — Jamie L McGowan
(74) *Attorney, Agent, or Firm* — Marshall, Gerstein & Borun LLP

(57) ABSTRACT

A snowplow blade removably attachable to a vehicle for contacting and plowing associated snow over a road guard rail as the vehicle moves. The snowplow blade includes a snowplow surface defining a trajectory for displacement of the snow between a lower substantially front-facing road-contact edge and an upper substantially side-facing outlet edge. An interface member provides removable attachment of the snowplow surface to the vehicle. The upper side-facing outlet edge is sized and positioned to project snow above a top surface of the road guard rail, thus reducing the accumulation of snow at the base of the guard rail.

11 Claims, 2 Drawing Sheets

SNOWPLOW BLADE

CROSS-REFERENCE TO RELATED APPLICATION

This is a regular filed application that claims priority to and the benefit of the filing date of U.S. Provisional Patent Application Ser. No. 61/968,065, entitled "Snowplow Blade" which was filed on Mar. 20, 2014, the entire disclosure of which is here by expressly incorporated by reference herein.

FIELD OF THE INVENTION

The present invention generally relates to snowplows, and is more particularly directed to a snowplow blade.

BACKGROUND

Snowplows are used for moving snow and ice from roadways.

However, clearing of snow and ice from roads in winter conditions with standard snowplows often results in the accumulation of snow and the formation of packed and hardened snow windrows on the side of the road.

When a vehicle loses control on the road, these snow windrows can lead tipping over of the vehicle, thus blocking at least one lane on the road.

In other circumstances, these snow windrows sometimes even become launching ramps for projecting an out of control vehicle over road guard rails, thus sometimes even leading to losses of life.

Accordingly, there is a need for a snowplow blade that addresses at least one of the above-mentioned problems.

SUMMARY

An object of the invention is to provide a snowplow blade that addresses at least one of the above-mentioned needs.

According to the present invention, there is provided a snowplow blade removably attachable to a vehicle for contacting and plowing associated snow over a road guard rail as the vehicle moves, the snowplow blade including:

a snowplow surface defining a trajectory for displacement of the snow between a lower substantially front-facing road-contact edge and an upper substantially side-facing outlet edge; and an interface member providing removable attachment of the snowplow surface to the vehicle, wherein the upper side-facing outlet edge is sized and positioned to project snow above a top surface of the road guard rail.

In an embodiment, the snowplow blade further includes a plurality of apertures formed in the snowplow surface providing air inlets at a bottom of the snowplow surface, creating an air cushion for facilitating displacement of snow along the trajectory on the snowplow surface.

In an embodiment, the snowplow blade is removably attachable to a front of a vehicle.

In another embodiment, the snowplow blade is removably attachable to a rear of a vehicle.

In an embodiment, the snowplow blade further includes a skid assembly positioned along the cutting edge for facilitating skidding thereof.

Some objects, advantages and other features will become more apparent upon reading the following non-restrictive description of certain optional configurations, given for the purpose of exemplification only, with reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Furthermore, although the present invention may be used with a snowplow, for example, it is understood that it may be used with other types of vehicles, for other purposes. For this reason, expressions such as "snowplow blade", "snowplow vehicle", etc. as used herein should not be taken as to limit the scope of the present invention to being used with a snowplow vehicle in particular. These expressions encompass all other kinds of materials, objects and/or purposes with other types of vehicles with which the present invention could be used and may be useful.

In addition, although the optional configurations as illustrated in the accompanying drawings comprises various components and although the optional configurations of the snowplow blade as shown may consist of certain geometrical configurations as explained and illustrated herein, not all of these components and geometries are essential and thus should not be taken in their restrictive sense, i.e. should not be taken as to limit the scope of the present disclosure. It is to be understood that other suitable components and cooperations thereinbetween, as well as other suitable geometrical configurations may be used for the snowplow blade, and corresponding parts, as briefly explained and as can be easily inferred herefrom, without departing from the scope of the disclosure.

Figure 1:
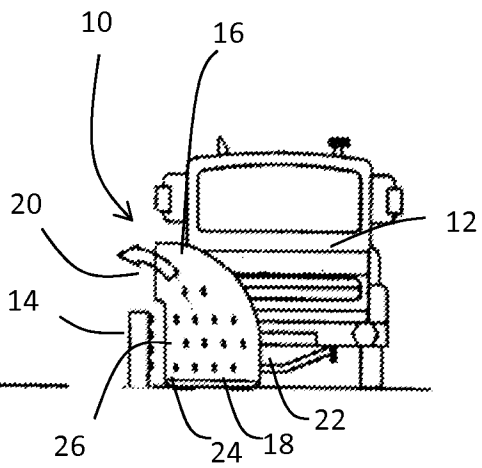
FIG. 1 is a front view of a snowplow blade in relation with a road guide rail, in accordance with an embodiment of the present invention.
Figure 2:
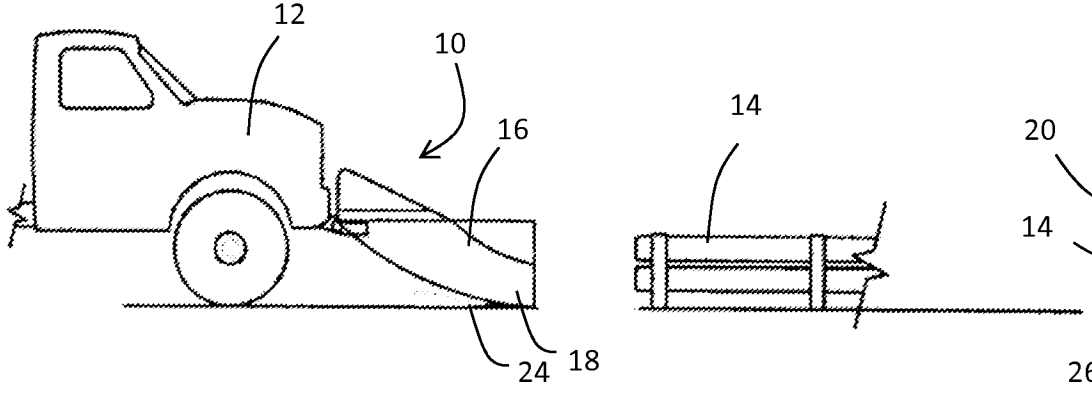
FIG. 2 is a side view of the snowplow blade shown in FIG. 1.
Figure 3:
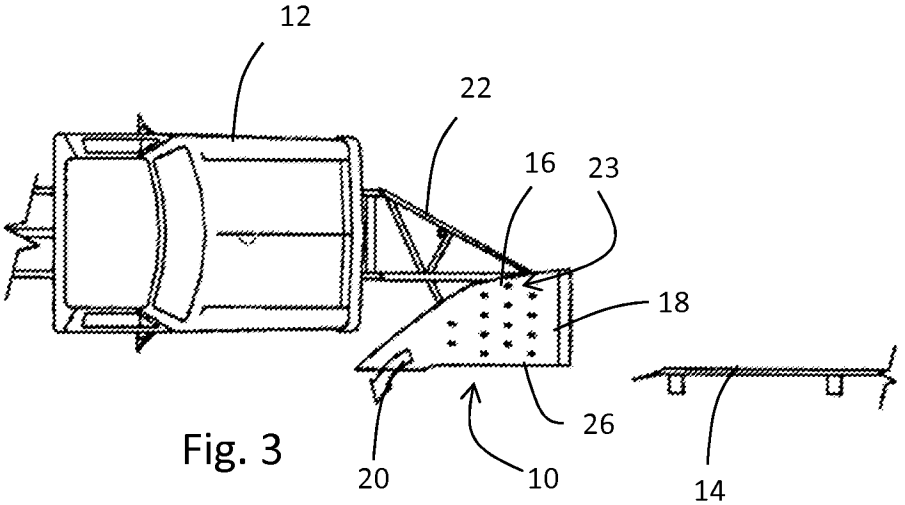
FIG. 3 is a top view of the snowplow blade shown in FIG. 1.
Figure 4:
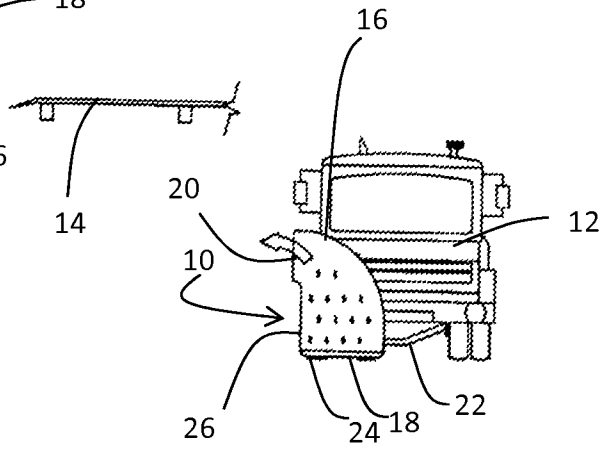
FIG. 4 is a front view of a snowplow blade, in accordance with another embodiment of the present invention.
Figure 6:
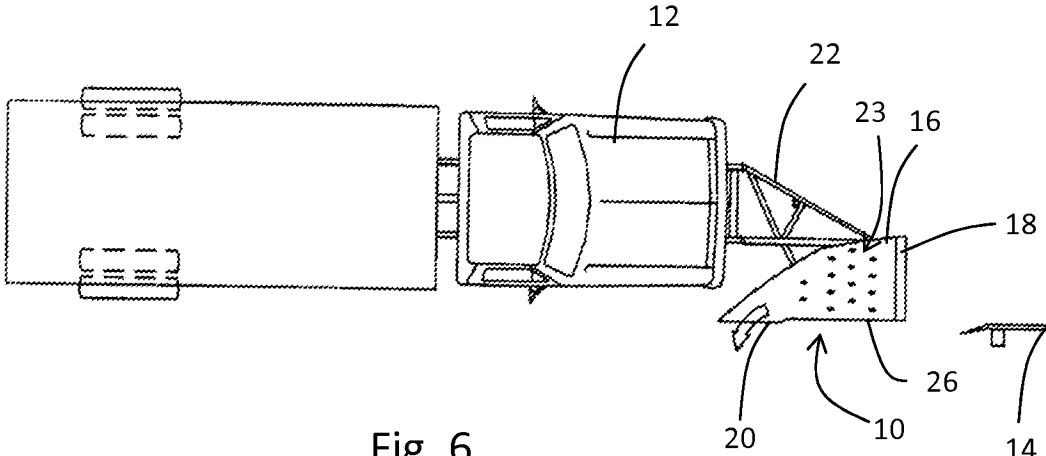
FIG. 6 is a top view of the snowplow blade shown in FIG. 4.
Figure 5:
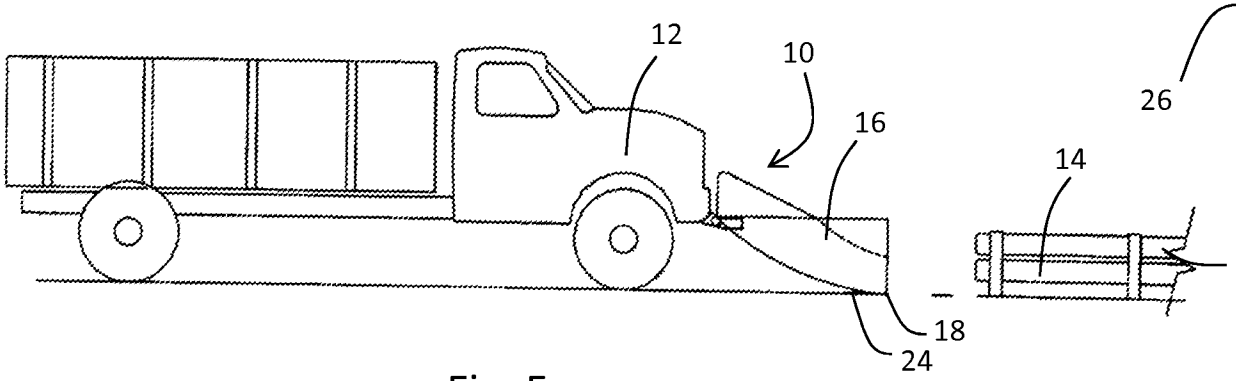
FIG. 5 is a side view of the snowplow blade shown in FIG. 4.

Referring to FIGS. 1 to 6, a snowplow blade 10 is shown. The snowplow blade 10 is removably attachable to a vehicle 12 for contacting and plowing associated snow over a road guard rail 14 as the vehicle 12 moves. The snowplow blade 10 includes a snowplow surface 16 defining a trajectory for displacement of the snow between a lower substantially front-facing road-contact cutting edge 18 and an upper substantially side-facing outlet edge 20. An interface member 22 provides removable attachment of the snowplow surface 16 to the vehicle 12. The upper side-facing outlet edge 20 is sized and positioned to project snow above a top surface of the road guard rail 14, thus reducing the accumulation of snow at the base of the guard rail 14.

In an embodiment, the snowplow blade 10 further includes a plurality of apertures 23 formed in the snowplow surface 16 providing air outlets for facilitating displacement of snow along the trajectory on the snowplow surface.

In an embodiment, the snowplow blade is removably attachable to a front of a vehicle.

In another embodiment, the snowplow blade is removably attachable to a rear of a vehicle.

In an embodiment, the snowplow blade further includes a skid assembly 24 positioned along the cutting edge for facilitating skidding thereof.

Preferably, the snowplow blade interface member is attached to displacement mechanisms or pistons to displace the blade laterally or vertically.

The apertures 23 effectively provide an air cushion on the blade for facilitating sliding of snow on the snowplow surface 16.

The snowplow blade can be offered in right-sided and left-sided configurations depending on the side of the vehicle on which the blade is to be installed.

After a standard snowplow vehicle has carried out its normal route along a road, a snow windrow is formed on the side of the road, sometimes in front of guard rails.

The standard snowplow blade can then be replaced with a snowplow blade in accordance with the present invention. The same vehicle can then travel once again along the same route and remove or at least vertically cut the accumulated and hardened windrow.

The removed windrow is thus ejected beyond the side of the road surface and liberates the area beside any steel guard rails. The guard rails can therefore continue to play its road safety role.

Preferably, the snowplow surface further comprises a vertical side cutting edge 26 for vertically cutting snow windrows. The vertically cut snow windrow that is hardened can effectively play the role of a naturally snow-formed guard rail.

In some embodiments, the snowplow blade can further include a proximity detection sensor system and associated warning system for detecting the proximity of guard rails.

The snowplow blade according to the present invention provides a rapid, safe and economical way of clearing snow from roads. Indeed, a vehicle equipped with such a blade can travel much more rapidly than a vehicle equipped with a snow blower that is often used to carry out similar tasks. Roads can therefore be liberated from snow clearing operations under shorter delays. In other cases, a vehicle equipped with the above-described blade can be more efficient as it can travel greater distances and provide longer distances of improved cleared roads. Cost savings result from reduced fuel consumption of a vehicle with a snowplow blade instead of a snow blower and from avoiding the use of safety personnel and associated equipment or vehicles that are typically required when using a snow blower.

The snowplow blade according to the present invention provides an economical way of clearing snow from roads as standard snowplow blades often result in an accumulation of snow windrows that exert a pressure that squeezes and damages guard rails, thus reducing their safety efficacy and sometimes leading to their replacement. The snowplow blade according to the present invention reduces this accumulation of snow windrows that damage guard rails. The reduction or removal of snow windrows at the foot of guard rails also helps sun and warm temperatures melt any remaining snow or ice on the side of the road, while also liberating the side of the road to allow water to flow away therefrom.

Of course, numerous modifications could be made to the above-described configurations without departing from the scope of the disclosure.

The invention claimed is:

1. A snowplow blade removably attachable to a vehicle for contacting and plowing associated snow over a road guard rail as the vehicle moves, the snowplow blade comprising:

a snowplow surface defining a trajectory for displacement of the snow between a lower front-facing road-contact edge and an upper substantially side-facing outlet edge;

an interface member providing removable attachment of the snowplow surface to the vehicle; and a vertical side cutting edge for vertically cutting snow windrows, a front edge of the vertical side cutting edge extending perpendicularly upwards with respect to a direction of travel of the front-facing road-contact edge, the front edge of the vertical side cutting edge being in register with the front-facing road-contact edge, wherein the upper side-facing outlet edge is sized and positioned to project snow above a top surface of the road guard rail.

2. The snowplow blade according to claim 1, further comprising a plurality of apertures formed in the snowplow surface providing air inlets at a bottom of the snowplow surface, creating an air cushion for facilitating displacement of snow along the trajectory on the snowplow surface.

3. The snowplow blade according to claim 1, wherein the snowplow blade is removably attachable to a front of a vehicle.

4. The snowplow blade according to claim 2, wherein the snowplow blade is removably attachable to a front of a vehicle.

5. The snowplow blade according to claim 1, wherein the snowplow blade is removably attachable to a rear of a vehicle.

6. The snowplow blade according to claim 2, wherein the snowplow blade is removably attachable to a rear of a vehicle.

7. The snowplow blade according to claim 1, further comprising a skid assembly positioned along the cutting edge for facilitating skidding thereof.

8. The snowplow blade according to claim 3, further comprising a skid assembly positioned along the cutting edge for facilitating skidding thereof.

9. The snowplow blade according to claim 4, further comprising a skid assembly positioned along the cutting edge for facilitating skidding thereof.

10. The snowplow blade according to claim 5, further comprising a skid assembly positioned along the cutting edge for facilitating skidding thereof.

11. The snowplow blade according to claim 6, further comprising a skid assembly positioned along the cutting edge for facilitating skidding thereof.

* * * * *